US007811204B2

(12) United States Patent
Popescu

(10) Patent No.: US 7,811,204 B2
(45) Date of Patent: Oct. 12, 2010

(54) ASSISTED ROPE CLIMBING APPARATUS

(76) Inventor: Marius Popescu, 3860 Lock Lomand Way, Livermore, CA (US) 94550

( * ) Notice: Subject to any disclaimer, the term of this patent is extended or adjusted under 35 U.S.C. 154(b) by 1063 days.

(21) Appl. No.: 11/439,829

(22) Filed: May 23, 2006

(65) Prior Publication Data

US 2007/0275829 A1 Nov. 29, 2007

(51) Int. Cl.
*A63B 7/04* (2006.01)
*A63B 9/00* (2006.01)

(52) U.S. Cl. ..... 482/37; 482/120

(58) Field of Classification Search ..... 482/23, 482/34–37, 92–96, 114–120, 44, 49; 182/241, 182/239; D21/676
See application file for complete search history.

(56) References Cited

U.S. PATENT DOCUMENTS

| | | | | | |
|---|---|---|---|---|---|
| 1,593,704 | A * | 7/1926 | Morris | 188/187 |
| 2,122,315 | A * | 6/1938 | Fosty et al. | 182/237 |
| 3,599,974 | A * | 8/1971 | Price | 482/118 |
| 3,782,718 | A * | 1/1974 | Saylor | 482/37 |
| 4,512,570 | A * | 4/1985 | Tardivel | 482/37 |
| 4,846,458 | A * | 7/1989 | Potts | 482/26 |
| 5,011,139 | A * | 4/1991 | Towley, III | 482/38 |
| 5,060,938 | A * | 10/1991 | Hawley, Jr. | 482/37 |
| 5,076,574 | A * | 12/1991 | Johnson, Jr. | 482/37 |
| D340,485 | S * | 10/1993 | Fripps | D21/673 |
| D343,876 | S * | 2/1994 | McConnell | D21/676 |
| 5,322,489 | A * | 6/1994 | Webb et al. | 482/38 |
| 5,380,258 | A * | 1/1995 | Hawley, Jr. | 482/37 |
| 5,484,360 | A * | 1/1996 | Haber et al. | 482/37 |
| 5,496,234 | A * | 3/1996 | Sussich | 482/37 |
| 5,554,083 | A * | 9/1996 | Chen | 482/95 |
| 6,261,208 | B1 * | 7/2001 | Carson, Jr. | 482/37 |
| 6,702,724 | B2 * | 3/2004 | Taylor et al. | 482/101 |
| 6,926,642 | B1 * | 8/2005 | Lampreda | 482/37 |
| 7,018,323 | B1 * | 3/2006 | Reynolds et al. | 482/37 |
| 7,060,003 | B1 * | 6/2006 | Reynolds et al. | 482/37 |
| 7,086,991 | B2 * | 8/2006 | Williams et al. | 482/37 |
| 7,303,506 | B1 * | 12/2007 | Reynolds et al. | 482/37 |
| 7,387,593 | B2 * | 6/2008 | Ryan et al. | 482/37 |
| 2004/0014568 | A1 * | 1/2004 | Williams et al. | 482/37 |
| 2005/0148437 | A1 * | 7/2005 | Ryan et al. | 482/37 |
| 2007/0275829 | A1 * | 11/2007 | Popescu | 482/37 |
| 2010/0081550 | A1 * | 4/2010 | Anderson et al. | 482/37 |

* cited by examiner

*Primary Examiner*—Loan Thanh
*Assistant Examiner*—Daniel F Roland
(74) *Attorney, Agent, or Firm*—Randick O'Dea & Tooliatos LLP; John Nielsen

(57) ABSTRACT

A rope-climbing exercise apparatus comprising, a support structure, a continuous rope, a means for applying resistance to the downward force on the rope applied by the user, and a means for applying upward force to the user.

18 Claims, 12 Drawing Sheets

ASSISTED ROPE CLIMBING APPARATUS

BACKGROUND OF THE INVENTION

Rope climbing is an effective form of exercise because it maintains the climber's arm and back muscles under dynamic tension. In other words, the climber's muscles are subjected to a pulling force resulting from part or all of the climber's weight as he supports himself on the rope, whether or not he is moving up or down on the rope. Superimposed on that force is an acceleration component that manifests itself when the climber pulls himself up or lowers himself down on the rope. Placing one's body under dynamic tension of this type improves one's muscle tone, blood circulation, respiration, and general mental and physical fitness.

Rope climbing may be practiced as an exercise in and of itself or as part of training for mountain or rock climbing.

There have been some efforts to make exercise machines that simulate the act of climbing a rope. Usually these machines require the user to pull down on a rope hand-over-hand, with the rope passing through some kind of friction or drag mechanism that offers resistance to the pulling motion. One example of such exercise apparatus is disclosed in U.S. Pat. No. 4,512,570. The trouble with this type of apparatus is that it really does not simulate accurately the act of rope climbing, which as noted previously, subjects the arms to dynamic tension whether or not the climber is moving up or down on the rope. In existing rope climbing exercise machines, no attempt is made to simulate the effect of the user's weight. In other words, no opposing force is exerted on the rope unless the user is actually accelerating the rope. Therefore, the user's muscles are not maintained under more or less constant tension as he pulls down on the rope, hand over hand. Rather, the force exerted on each arm varies from some maximum value at the top of each pulling motion to near zero at the bottom of the stroke. Such variable or intermittent tensioning of the body muscles is not as effective as constant dynamic tension in conditioning the body.

Another limitation to the existing prior art is the lack of an assisting upward force to assist the user during use. This upward force, as provided in this apparatus, allows users of all fitness levels to use, and obtain the conditioning benefits of, the apparatus. The upward force applied to the seat or platform, in conjunction with the governor and braking systems, gives the user the feeling and impression that they are genuinely climbing up a rope.

Also, prior exercise machines of this general type have tended to be fairly large and complicated pieces of machinery that take up a large amount of floor space and are relatively expensive to make.

It is therefore an object of the invention to provide an assisted rope climbing exercise machine that is safe and that permits natural body movement during the exercise.

A further object of the invention is to provide a rope climbing exercise apparatus that is adjustable to accommodate users whose strengths vary over a relatively wide range.

Another object of the invention is to provide an exercise apparatus of this general type that is relatively compact and that requires a relatively small amount of floor space.

Still another object of the invention is to provide a rope climbing exercise apparatus that is composed of relatively few components that are easy and inexpensive to fabricate.

Other objects will, in part, be obvious and will, in part, appear hereinafter.

The invention accordingly comprises the features of construction, combination of elements and arrangement of parts that will be exemplified in the following detailed description, and the scope of the invention will be indicated in the claims.

SUMMARY OF THE INVENTION

Briefly, the exercise apparatus comprises an upstanding frame that supports a system of pulleys around which the rope is trained to form an endless loop. The loop includes a vertical stretch of rope situated at one end of the frame that one can grasp and pull down in hand over hand fashion to simulate climbing the rope. Preferably, a seat is located adjacent to that end of the frame on which the user may sit or kneel while the user is exercising.

As the user pulls on the rope, the apparatus provides resistance to the downward force via a governor. The governor is a mechanical subassembly that converts inertia (rotational) forces into linear (axial) forces. In certain embodiments of this invention, the motion of the governor is amplified with the help of gears, pulleys, belts, and/or sprockets with a roller chain in order to achieve sufficient inertial forces to properly brake the system.

The brake system, the governor, and the rope create a closed loop. As the user climbs the rope, the rope spins the governor, the governor then uses the spinning motion (inertia) and converts this force into linear forces that are used to activate the brake system. The brake system controls the speed and resistance the user feels during use.

In other embodiments of this invention the governor and brake system can be replaced by an electric motor which is mechanically linked to the rope via sprockets and chains, and or gears, and or pulleys with belts. By controlling the current that drives the motor one can control the speed with which the motor spins thus controlling the speed of the rope.

The user is assisted during exercise via a sitting or kneeling platform attached to the apparatus. As the user sits or kneels on the platform, the platform provides an upward force on the user. The upward force can be provided by a stack of weights that are linked to the platform via a cable and pulleys. This embodiment allows the user to select a number of weights to couple to the system, thus allowing adjustment to the upward force on the platform.

Other embodiments allow the user to select the desired amount of assistance via the use of functionally connected springs, cables, and pulleys, as well as motor driven assistance. When using the spring instead of the weight plates, changing the amount of resistance or assistance to the platform can be accomplished by restraining certain numbers of coils in the spring from being actuated. This action would be equivalent to adding more weight plates. In one embodiment, coils are restrained from being actuated thus providing adjustment to the amount of resistance. In using just the spring as described so far, the forces are not linear, so as the spring starts to be actuated, the forces increase through out the range of actuation.

The non-linear spring forces can be changed into linear forces by introducing an eccentric pulley or "nautilus". A nautilus works just as a cam where as the spring is actuated via a cable wrapped around this eccentric pulley, the change in resistance from the spring is cancelled by the changes to the moment arm on the eccentric pulley. This allows the forces on the platform to remain constant and linear throughout the range of motion.

Another embodiment involves the use of a conical spring to attain near linear forces throughout the range of motion of the spring. This embodiment does not require the use of an eccentric pulley.

In all of these different spring embodiments, the user only need interact with the adjustment feature that changes the number of coils allowed to work in a given setting. This coil restraint adjustment feature can comprise a variety of different methods, including a pin capable of being pushed to into the coils, or a collar capable of tightening around the outside of the spring at different locations to dictate which coils get actuated.

These and other objects, features, and advantages of the present invention are provided by an exercise apparatus including guide means connected between a frame and a kneeling platform for guiding the kneeling platform along a predetermined and generally vertical path of travel as the user pulls on the rope.

DETAILED DESCRIPTION OF THE DRAWINGS

Figure 1:
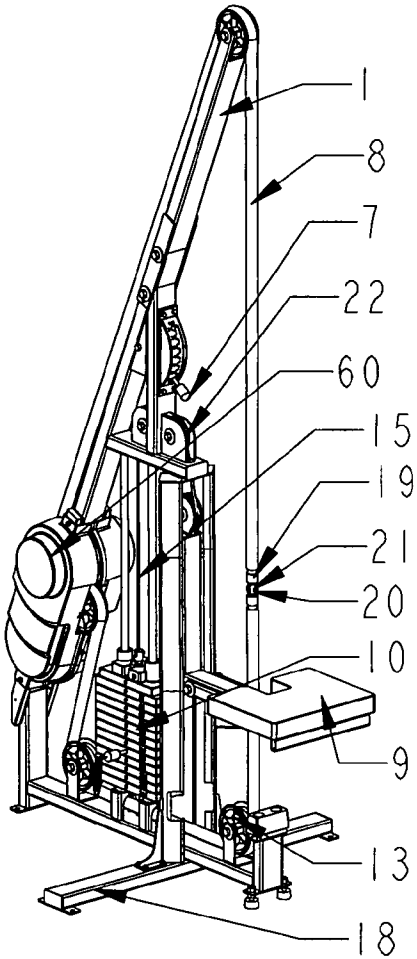
FIG. 1 is a perspective view of an embodiment of the invention.

Referring to FIG. 1 there is shown an exercise device comprising a skeleton 1, which comprises the main support structure of the invention. Due to the significant forces the invention will be subjected to during use, a preferred embodiment of the skeleton 1 will made from strong materials, such as metal or other materials capable of withstanding significant forces. Detachable side leg 18 is shown attached horizontally to the skeleton 1 to provide stability to the overall apparatus. Rollers 13 are used to control the direction/path of the rope 8. A cover 60 houses several components, including components that control rope speed. The platform 9 allows the user to sit or kneel during use. Weight plates 10 allow users to offset body mass and climb while lifting less than 100% of their body weight. Rope ends 19, along with half spheres 20 and link 21 allow the rope ends to join and form a closed loop. Cable 15 connects weight plates 10 to the platform 9 via pulleys 22. Shift handle 7 allows the user to interface the apparatus to set the desired rope 8 speed.

Figure 2:
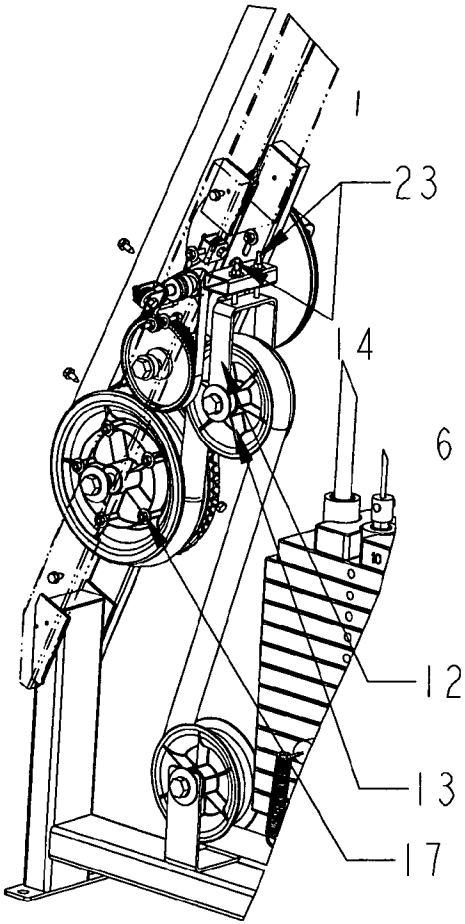
FIG. 2 is perspective view of a portion of an embodiment of the invention.

FIG. 2 shows an expanded view of a portion of the invention. In this drawing, covers 60 have been removed to show internal components. The rope-gripping roller 17 is linked to the rope tensioning bracket 12 via a roller 13. When actuating screws 23, the rope tensioning bracket 12 and roller 13 get displaced thus increasing tension on the rope 8 (FIG. 1). The motion generated by the user pulling the rope 8 is transferred to a gear 14 via rope gripping roller 17.

Figure 3:
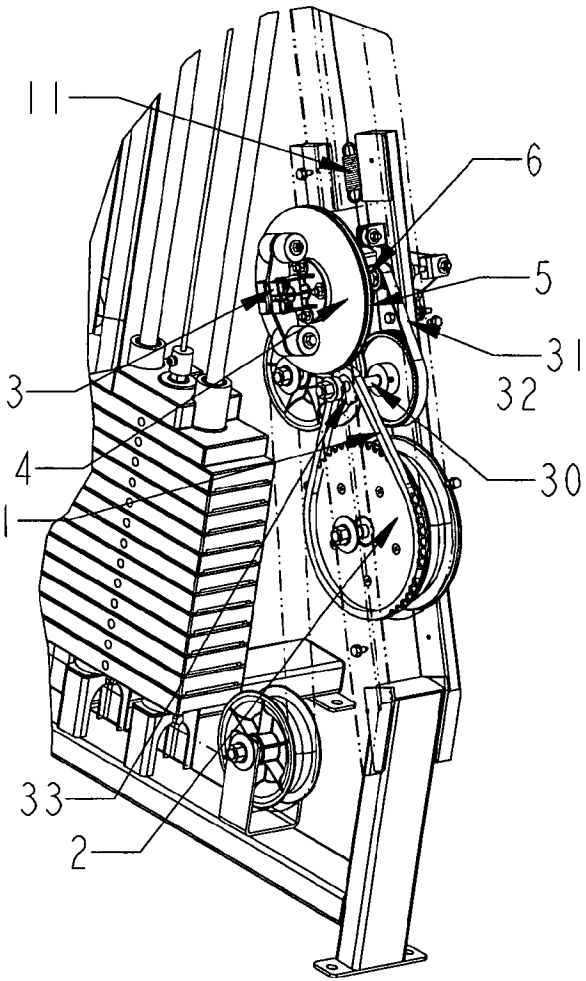
FIG. 3 is perspective view of a portion of an embodiment of the invention viewed from the side opposite to that shown in FIG. 2.

FIG. 3 shows the sprocket 2 is mounted onto the rope gripping roller 17 (FIG. 2) and transfers the energy generated by the user during exercise to the axis 30, then onto gear 14 (FIG. 2) via gear 32 and belt 31. This force is then transferred to the governor 3 that, as it spins, forcing the brake disks 4 and 6 to compress the buffer pad 5. The engaged brake system 4, 5, 6 will cause the movement of the rope 8 to slow.

High torque loads are generated by the user during exercise. To avoid rope slippage at the rope-gripping roller 17, a sprocket and roller chain transfer motion to an intermediate axis 30. From this intermediate axis 30, the motion is further transferred to the axis of the governor 3 via a plurality of gears 32 and rubber belt 31 (See FIG. 4). In a preferred embodiment, gears and rubber belts can be used to reduce noise that might be associated with the use of a sprocket and roller chain spinning at high RPM. As the gear ratio increases the speed for gear 14, the torque loads should decrease by the same ratio for gear 14.

The governor 3 is part of a mechanical subassembly in the apparatus that converts inertia (rotational) forces into linear (axial) forces. A purpose of the governor 3 is to regulate the speed of the rope during use. The governor 3, along with the related parts, including but not limited to the braking system 4, 5, 6, spring 11 and gears and sprockets 2, 14, 32, 33 allow the user to adjust the rope's 8 range of speeds and resistance to downward pulling force. The motion of the governor 3 is amplified by the sprocket 2, 33 and gears 14, 32 and is amplified to convert the given inertial forces into sufficient linear force to properly brake the system during use. As the user pulls down on the rope, this provides rotational force to the large sprocket 2. The small gear assembly 14 (See FIG. 2) is in functional link with sprocket 2 via a plurality of sprockets, roller chain 61, gears 32, and belts 31. As the large sprocket 2 rotates during use, the small gear 14 is rotated at a significantly faster rate than the large sprocket 2. The small gear 14 (FIG. 2) is attached to the governor 3, which spins at the same rate as the small gear 14.

Figure 4:
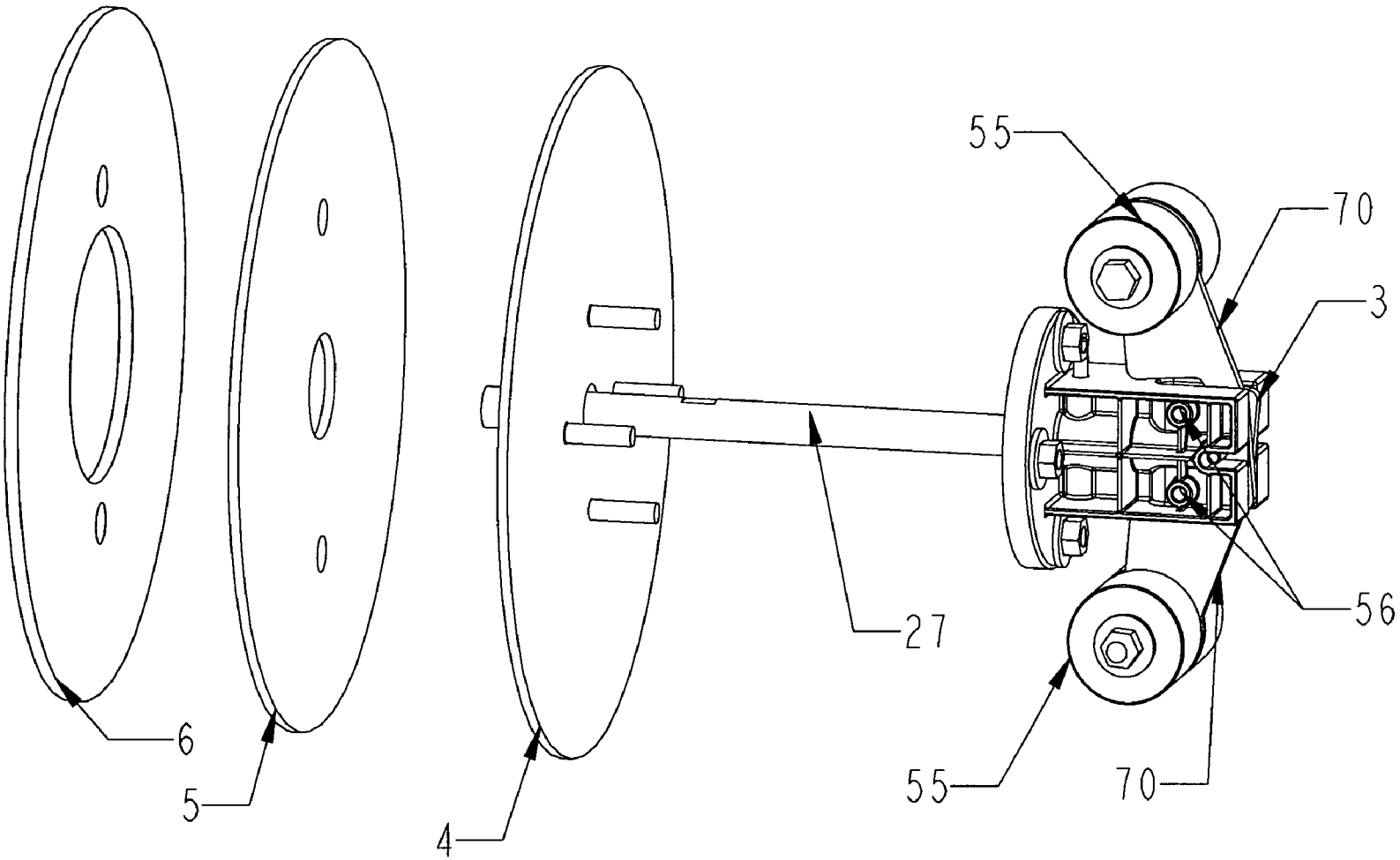
FIG. 4 is an exploded view of the governor, brake disks and brake buffer.

FIG. 4. As the governor 3 spins during use, the governor weights 55 rotate about the axis 27. Due to centrifugal forces, the governor weights 55 begin to rise off the plane of the brake disk. In one embodiment, the governor weights 55 are attached and hinged to the governor 3 via mounting brackets 70, and as they rise from the plane of the brake disk during use, the other end of the mounting brackets 70 press on pins 56 that are attached to the interior of the governor 3. When a certain level of pressure from the above-described action has been placed on the governor pins 56, the governor presses into the mobile brake disk 4. As this occurs, friction is created between the mobile brake disk 4, the buffer 5, and the fixed brake disk 6. This friction tends to slow the mobile brake disk 4, which in turn tends to slow the governor 3, the small gear 14 (FIG. 2), the large sprocket 2 (FIG. 3), and finally the rope 8 (FIG. 1).

Figure 5:
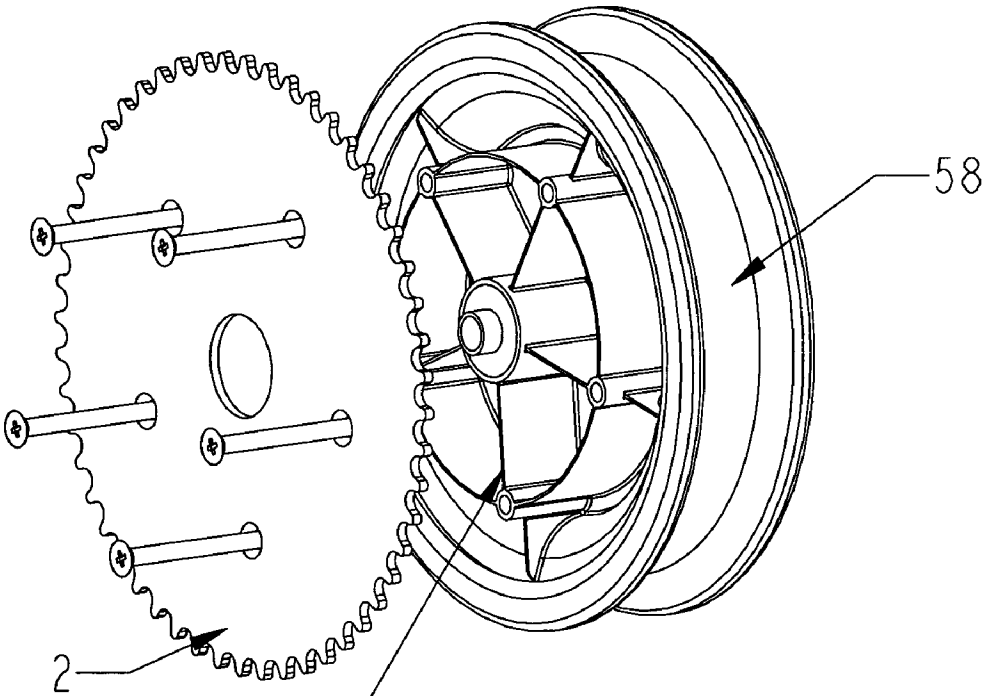
FIG. 5 is an exploded view of the rope gripping roller and the sprocket.

FIG. 5. The rope gripping roller 17 is attached to the sprocket 2. Contact between the rope and the roller 17 is assisted by including a rubber surface 58 onto the roller 17.

Figure 6:
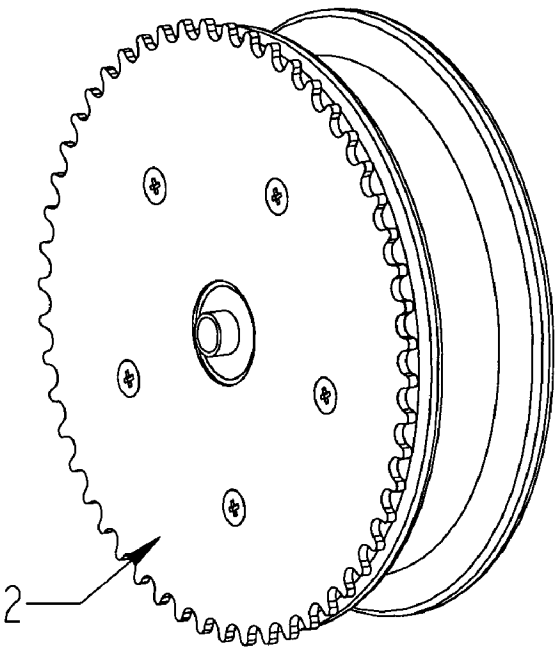
FIG. 6 is a perspective view of the rope gripping roller and sprocket.

Referring to FIG. 6, it shows the final assembly of the sprocket 2 and roller 17 (See FIG. 5) which comprise the rope gripping roller.

Figure 8:
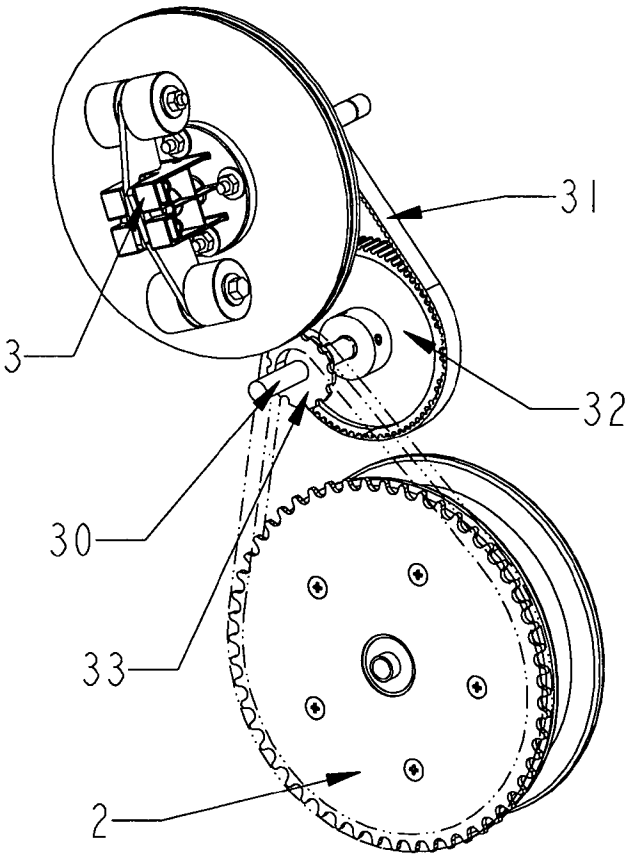
FIG. 8 is a perspective view of the gears and sprockets connected to the governor and brake mechanism viewed from the side opposite to that shown in FIG. 7.
Figure 7:
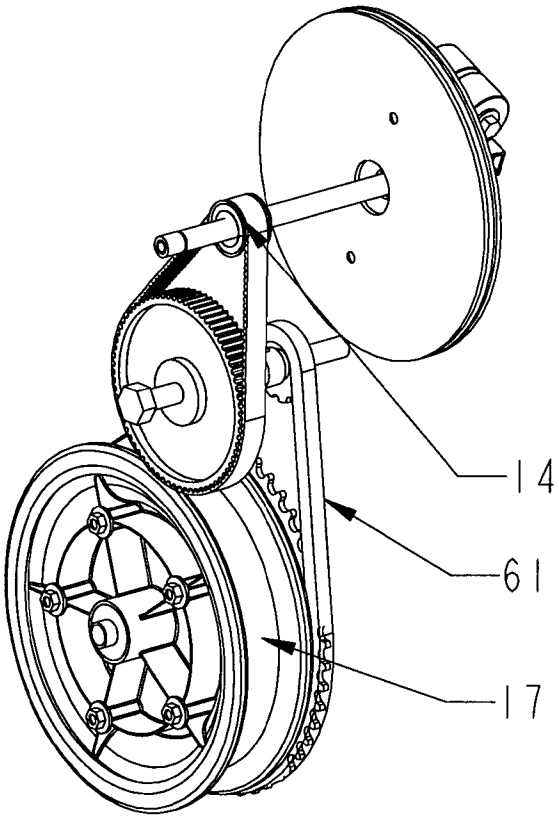
FIG. 7 is a perspective view of the gears and sprockets connected to the governor and brake mechanism.

FIGS. 7 and 8 detail how the rope gripping roller 17 transfers the motion to the small gear 14 via the roller chain 61 and rubber belt 31. The large sprocket 2 is linked to the small sprocket 33 by roller chain 61 (FIG. 7). The small sprocket 33 and gear 32 can be locked onto the mid axis 30 causing them to spin at the same rate. As rope 8 (See FIG. 1) moves during use, the rope gripping roller 17 spins the large sprocket 2, which then spins the roller chain 61, which causes the small sprocket 33 to spin, as well as the mid axis 30, gear 32, belt 31, gear 14 and the governor 3. The spinning motion of the governor activates the brake system 4, 5, 6 (FIG. 1) which then slows the rope 8 via the process described above.

Figure 10:
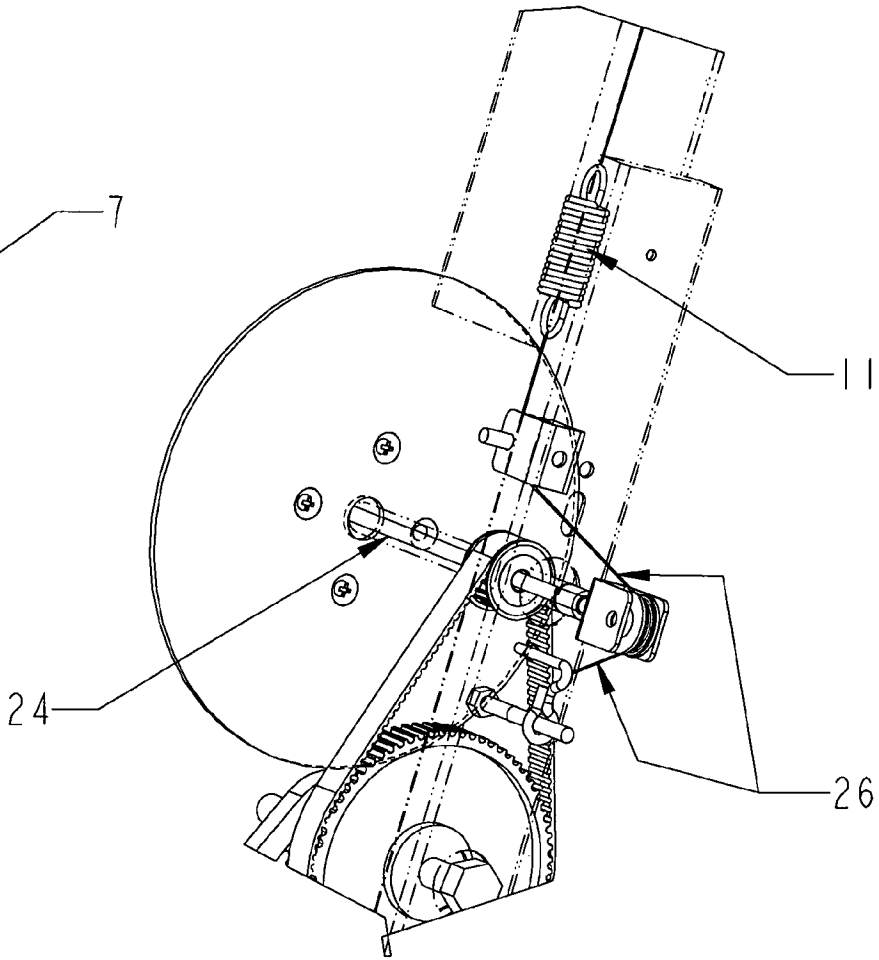
FIG. 10 is perspective view of the brake elements that connect to the shift handle.
Figure 9:
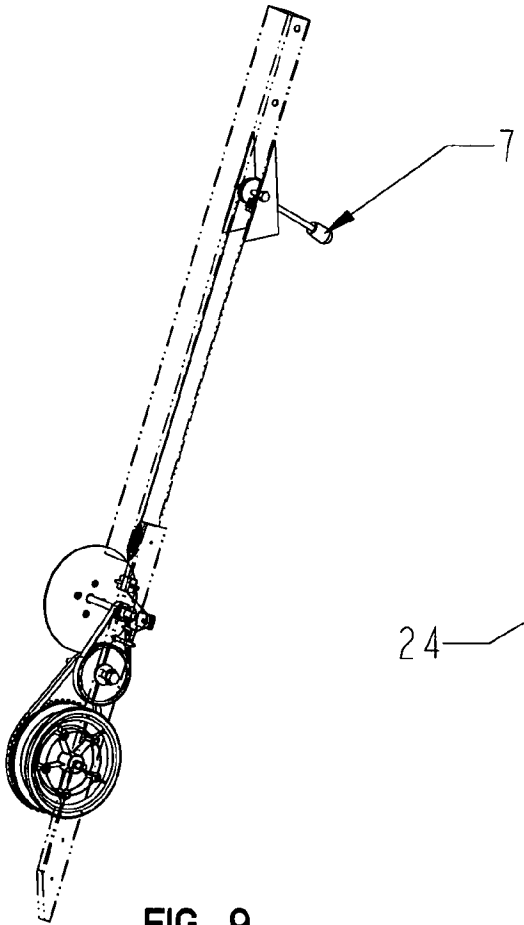
FIG. 9 is a perspective view of the shift handle as it relates to the brake mechanism. For visual clarification some of the metal structural beams are displayed in a "see through" mode.

Referring to FIGS. 9 and 10, the shift handle 7 is shown that allows the user to adjust the rope speed, through the use of the governor 3 and brake assemblies 4, 5, 6. The shift handle 7 allows the user to pre-set the system to engage the braking system at the desired rope speed. The shift handle 7 is attached to the extension spring 11, and the frame 1. Manipulation of the shift handle 7 adjusts the tension on the spring 11, and in turn, affects the tension rod 24, via the cable 26, which then affects the speed/resistance of the rope.

Figure 12:
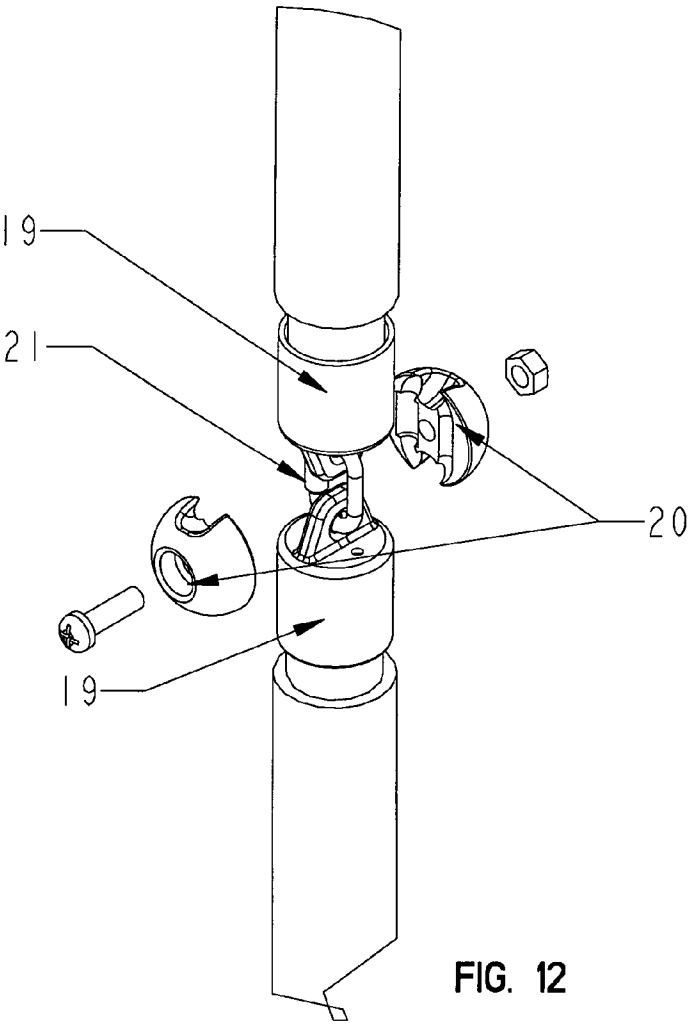
FIG. 12 is an exploded view of the rope ends and associated components.
Figure 11:
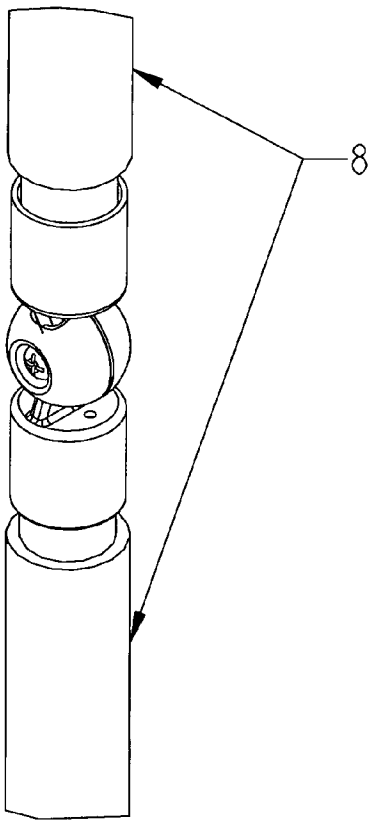
FIG. 11 is a perspective view of the rope ends connected together to form the closed loop.

Referring to FIGS. 11 and 12—The rope 8 is what the user grasps and pulls during use. The rope 8 can be made from a variety of different materials. The rope 8 can be an endless loop of the same material, or a composite of different materials. In a preferred embodiment, a predetermined length of rope, appropriate in length for the apparatus, has end caps 19 capable of engaging each other. The end caps can be secured to the end of the rope in a variety of ways: by epoxy, by crimping the ends onto the rope, by driving fasteners through the end cap and the rope as well and by insert molding a polymeric composite cap onto the rope. The joining of the two ends of the rope could utilize a link 21, preferably metal or some other material capable of withstanding strong forces. Two half spheres 20 are shown which, when attached together around the link, provide for increased comfort during use. The rope 8 can be looped through the apparatus and change directions as travels around the rollers 13 (FIG. 1). The term 'loop' does not require that the rope remain in a circular or oval shape, and in the drawings shown herein, the rope is not in a circular or oval shape.

Figure 13:
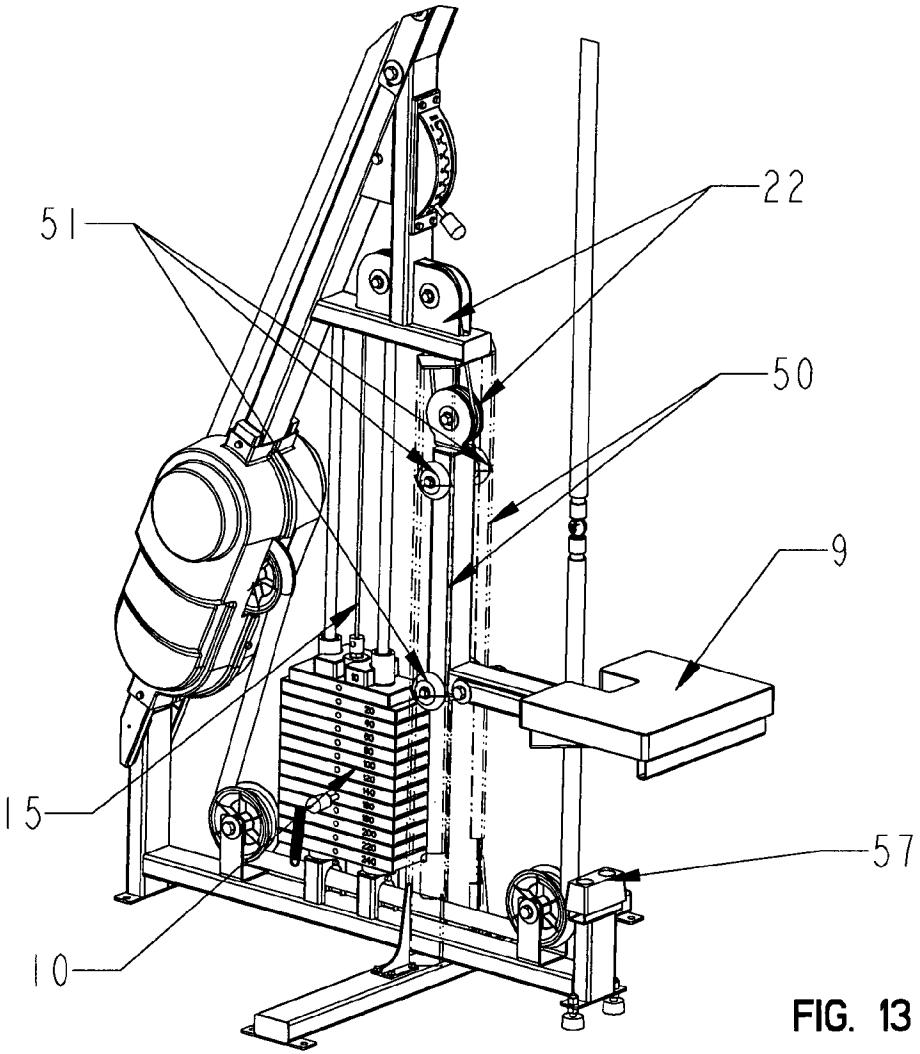
FIG. 13 is a perspective view of the platform and elements that connect it to the apparatus. For visual clarification some of the metal structural beams are displayed in a "see through" mode.

FIG. 13. The platform assembly 9 includes a seat or bench on which the user sits or kneels during use. In a preferred embodiment, the platform 9 can be connected to a stack of weight plates 10 via a cable 15 and pulleys 22. Rails 50, and rollers 51 guide the platform 9 up and down, which allows the user to climb while lifting less than all of their body weight. In this figure, the rails 50 are shown in phantom lines so the hidden rollers 51 can be illustrated as well. These rollers 51 allow the platform to move up and down inside the rails 50. In this embodiment, the user can select an amount of weights to engage during use. At various times during use, the platform will then supply an upward force on the user. The amount of upward force applied to the platform correlates to the amount of weight the user has selected.

Although not shown in a figure, rods can replace rails 50 and 51, and rollers 51 can be replaced by bearing sleeves which would slide on the rods, or a plurality of rollers which would roll on the surface of the rods.

Although not shown in a figure, alternative embodiments include means other than the utilization of a weight stack to provide the upward force applied to the platform, including but not limited to spring(s), which can be connected to the platform via cable 15 and pulleys 22. Just as one can select a number of weight plates 10 to adjust the upward force applied to the platform, a spring can also accomplish this by varying the length of spring that is actuated. The term actuation is used since both compression and/or extension springs can be utilized. An extension spring can be switched to a compression spring (or visa versa) via the inclusion (or removal of) an extra pulley 22 to reverse the direction of the cable 15. In one embodiment, one end of the spring could be secured to the frame 1 and the other end would connect to the cable 15. The cable could then be fed through pulleys 22.

In the embodiment shown in FIG. 13, it is expected that as the user seats or kneels on platform 9, it will lower itself until stopped by the stopper 57. The stopper 57 will ideally be composed of rubber, or some other material that minimizes shock and sound. The distance between platform 9 and stopper 57 is the platform's likely travel/operational range. Within this range is where the user tends to stay suspended during workout. As the user performs the hand over hand climbing motion, the platform 9 will allow the user to pull up and lower their body between each hand pull. This up and down bobbing motion of the user's body gives one the sensation of actually climbing. Another feature of this weight assisted platform 9 is that as the user climbs faster, the weighted assist from the weight stack causes the platform 9, along with the user, to rise relative to the user's surroundings. As the user slows their rate of climbing, their position will fall relative to the user's surroundings until in contact with rubber stopper 57. Very fit individuals may be able to climb to the point that they will lift their body clear of the platform.

Figure 14:
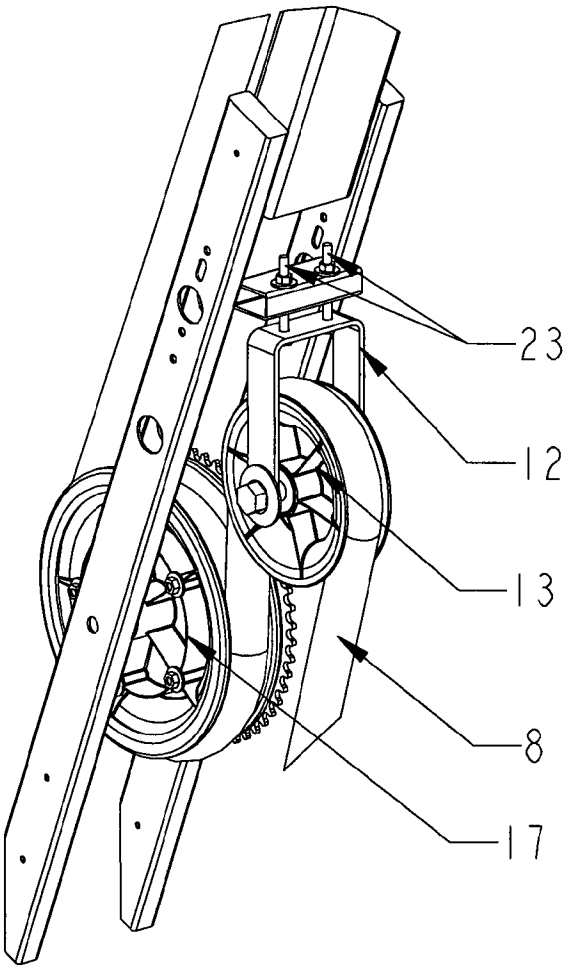
FIG. 14 is a perspective view of the rope tensioning mechanism in the invention.

FIG. 14. Preferably the tension in the rope during use remains relatively constant at all times. The tension in the rope should be sufficient to maintain constant contact with the pulleys 13, 17 without slippage during use. Therefore in a preferred embodiment, the tension in the rope is adjustable, but will not be a normal variable for the user to adjust. A rope tension bracket 12 is part of the rope tensioning assembly that is meant to allow slack to be taken out of the rope 8. The rope tensioning assembly shown in this drawing comprises a roller 13 that is attached to one or more bolts 23 via a bracket 12. As the bolts 23 are tightened, it pulls the roller 13, which increases the tension in the rope 8.

Figure 15:
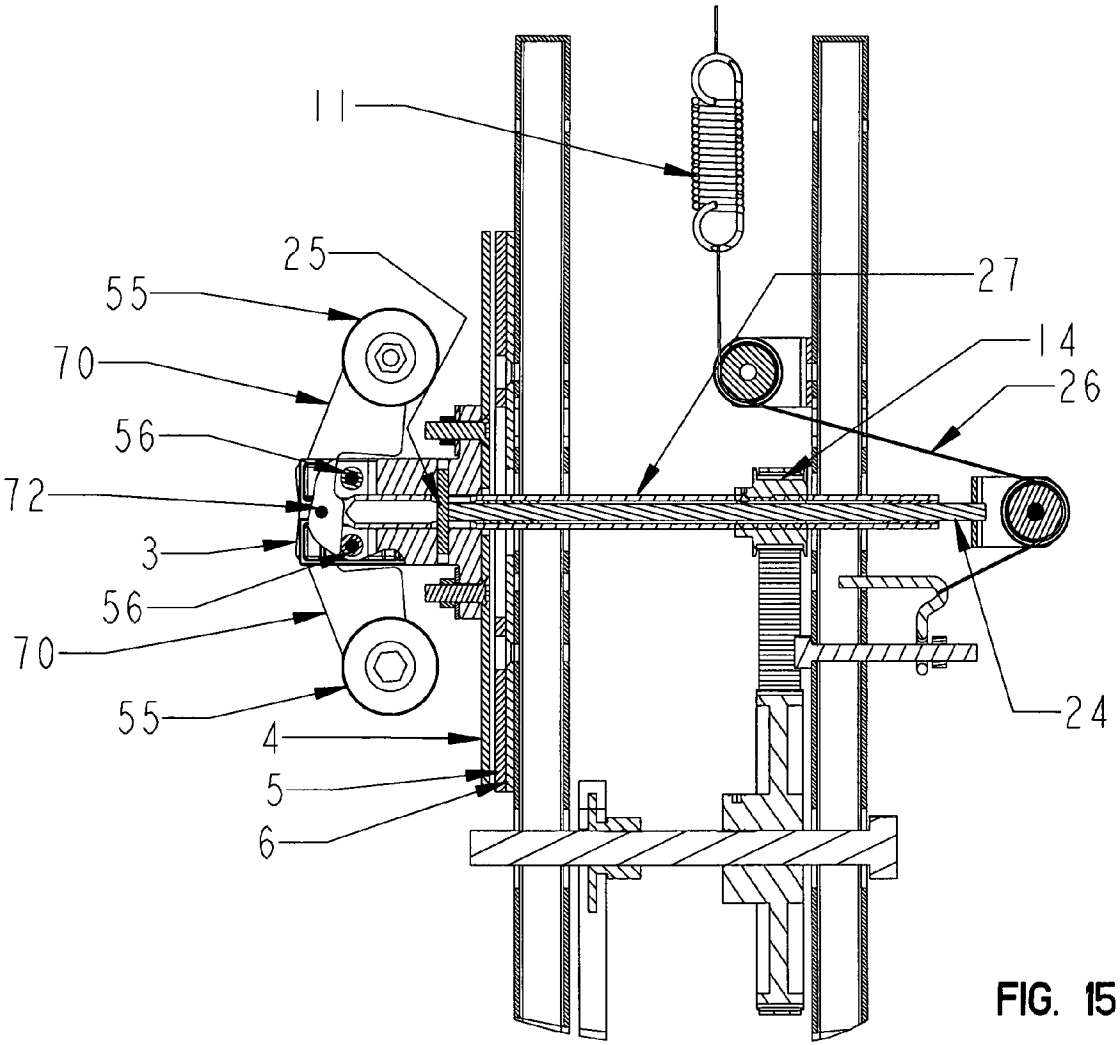
FIG. 15 is a cross sectional view of the governor and brake mechanism.

FIG. 15. Another element to the governor/braking system is a tension rod 24 that can be placed within the axis sleeve 27 of the small gear 14. This tension rod 24 does not need to spin with the small gear 14, and in a preferred embodiment, does not spin. The tension rod 24 is intended to move in an axial direction. One end of the tension rod abuts a pin 25 that is attached to the governor 3. Said pin 25 is located parallel to the brake disk and buffer pad 4, 5, 6 and rotates at the same rate as the governor 3. The tension rod 24 and the pin 25 contact each other in a perpendicular configuration. As the governor 3 engages the braking system during use, force is transferred from the pin 25 in the governor 3 to the tension rod 24 within the governor 3. At the opposite end from the governor 3 the tension rod 24 can be connected to the extension spring 11 via a cable 26. At rest, the spring 11 and cable 26 assembly apply sufficient force on the tension rod 24 to move the tension rod 24 towards the governor assembly. When the user generates sufficient rope speed during use, the governor 3 assembly generates forces greater than the spring 11 force and moves the tension rod 24 back towards the cable 26. This system assists the user in setting the range of rope speeds the user will encounter during use.

In a preferred embodiment, the mobile brake disk 4 is attached to, and spins at the same rate as, the governor 3. During use, the mobile brake disk 4 moves in the same directions as the governor, and thus it responds to the forces applied by the governor during use, allowing it to move along its axis. The axial motion of disk 4 is caused by the pushing force from weights 55 as these rise off plane due to centrifugal forces. The weights 55 are connected to the governor 3 via brackets 70 which are hinged onto the governor 3 via a pin 72. As the brackets 70 and the weights 55 rise off plane, they press onto pins 56 thus pushing the governor axially to engage the braking system, 4, 5, and 6. At various times during use, the mobile brake disk 4 comes in contact with the buffer pad 5 on the fixed brake disk 6, which causes friction, which in turn tends to reduce the speed of the rope 8. The buffer pad 5 reduces wear and tear on the mobile and fixed brake disks, while also reducing noise from friction between the brake disks. The buffer pad 5 is preferably made from materials that will dissipate heat while not creating excessive noise during use.

The fixed brake disk 6 preferably has the buffer pad 5 attached to it, and does not spin during use. It also does not move along the axis of the governor. The fixed brake disk 6 can, however, pivot about its center to adjust for any surface irregularities in either of the brake disks 4, 6, or the buffer pad 5.

Figure 16:
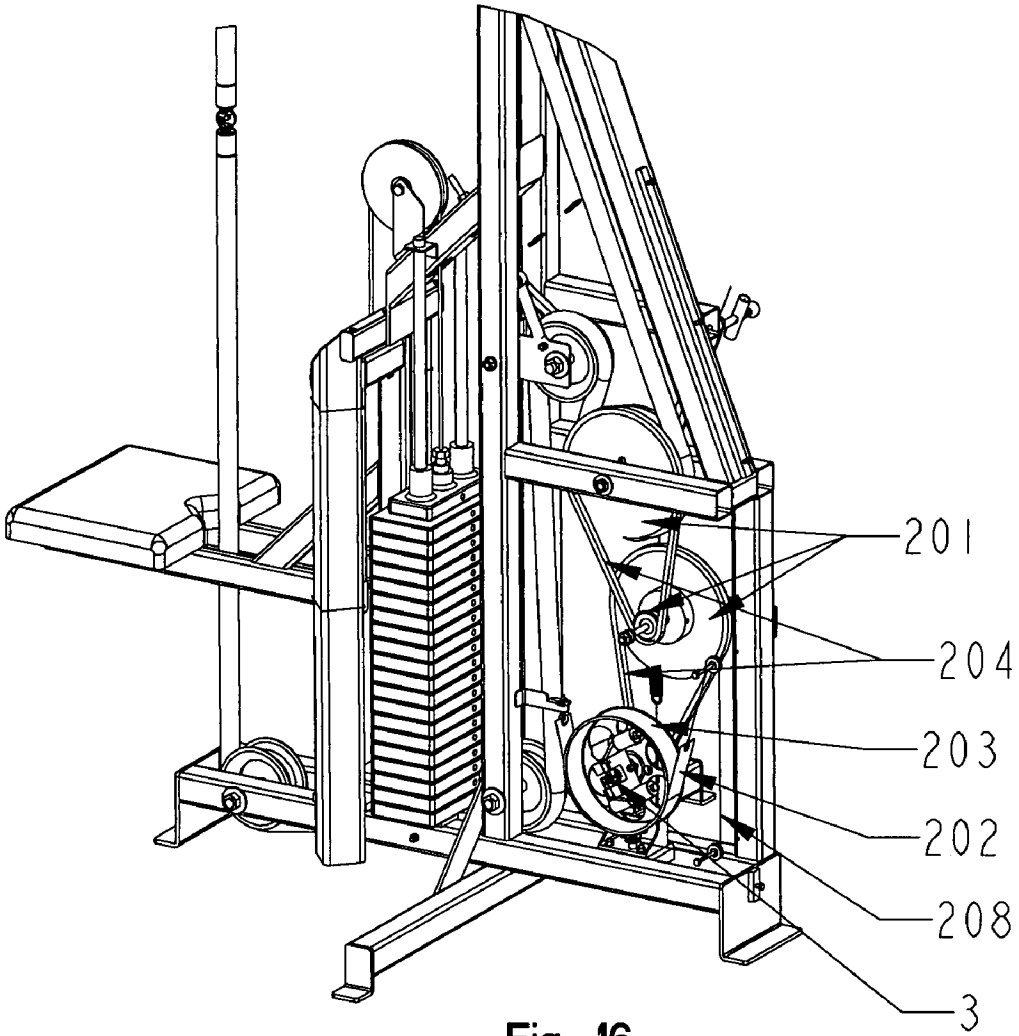
FIG. 16 is a perspective view of the drum and belt governor.

FIG. 16 illustrates an embodiment wherein the brake disks 4, 6 and the buffer pad 5 have been replaced by a drum 203 and a belt 202. In this configuration, during use, the drum 203 will spin at substantially the same speed as the governor 3 and its rotational forces will be turned into linear forces capable of pulling the belt 202 which in turn applies friction to the drum 203, thus regulating the rope speed as discussed above. In one embodiment, the rope is slowed when the belt 202 is tightened on the drum 203 by having the belt 202 connected to, and translate the axial force from, the governor 3 through a connecting means, such as wire cable 208. This wire cable 208 can be connected to the pin 24 in the governor as discussed above. The forces of the governor 3 push this pin 24 axially during use when the rope 8 reaches a certain speed. This axial force on the pin 24 then pulls on the cable 208, which in turns pulls the belt 202. This action slows the speed of the drum, and thus the rope.

Referring to FIG. 16, in an alternate embodiment, the gears can be replaced by a system of pulleys and belt(s) that are used to regulate the speed of the rope by transferring and amplifying motion from the rope 8 to the governor 3. In said alternate embodiment, pulleys 201 are linked together to the governor 3 by belts 204. In this example two sets of pulleys are used to achieve the needed pulley 201 ratio, which directly impacts the efficiency of the governor 3. This allows the governor 3 to spin at a faster speed than the rope, which allows the governor to function properly.

Figures 17, 18, 19:
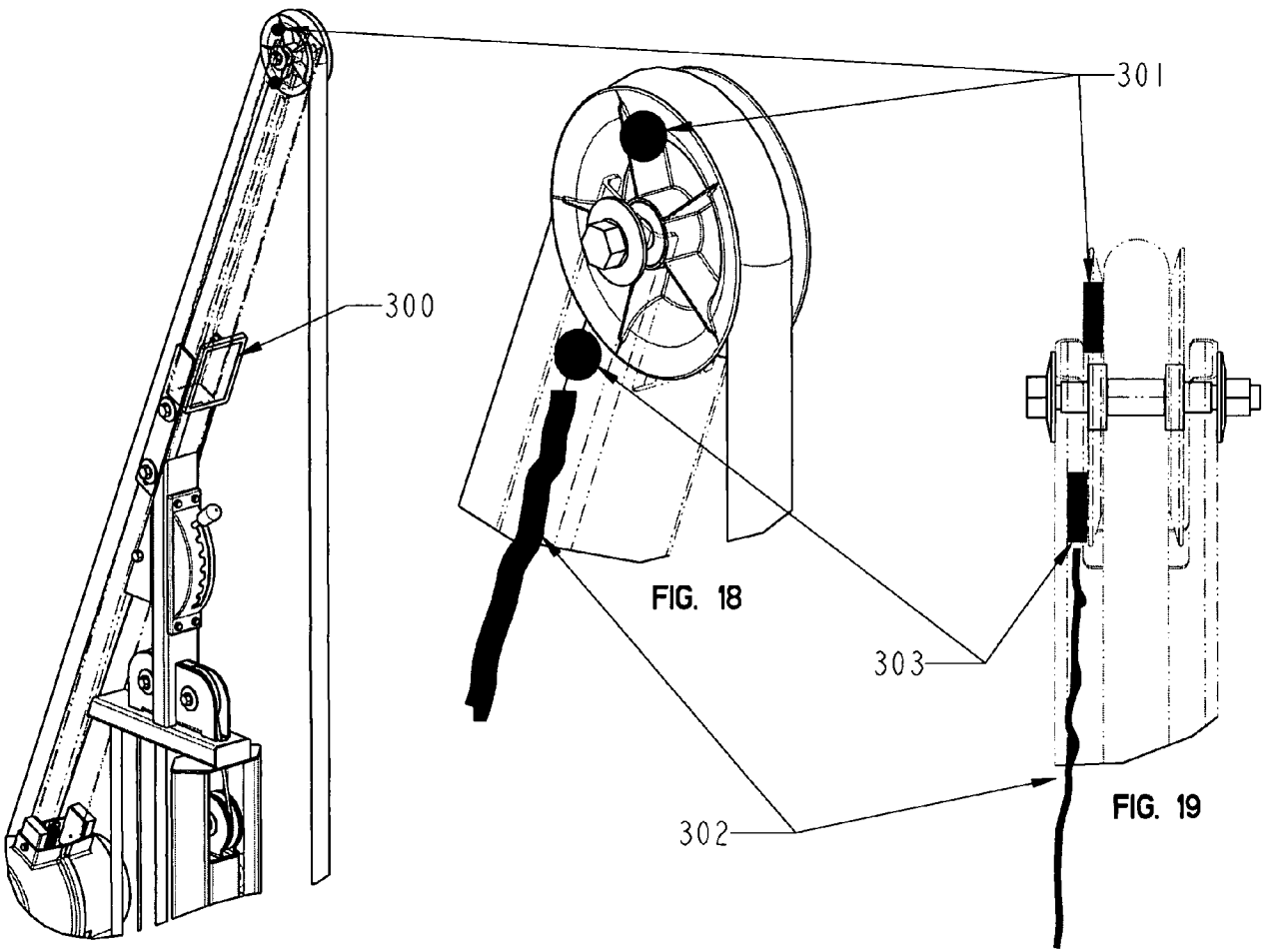
FIG. 17 is a perspective view of the display screen.
FIG. 18 is a close up perspective view of the components relating to data collection for information shown on display screen.
FIG. 19 is a side view of the components relating to data collection for information shown on display screen.

FIGS. 17, 18 and 19 illustrate an electronic display screen 300 that can provide information and visual stimulus to the user, including workout status and progress. The display screen can provide information such as workout duration, speed of the rope and distance climbed. This can be achieved by having the display screen 300 connected to a set of magnetic sensors 301 and 303 via an electric wire 302. One magnetic sensor 303 will be static, placed onto the frame directly in line with the second magnetic sensor 301 which will rotate with the rope roller. Magnetic pulses will be registered and sent down the wire 302 to the display screen 300 as the two sensors pass by each other. In this embodiment the magnetic sensors are making use of the spinning motion of the top rope roller. It would also be feasible to place the magnetic sensors to make use of motion of any other spinning elements in the system such as the governor or any of the other rope rollers.

Figures 20, 21:
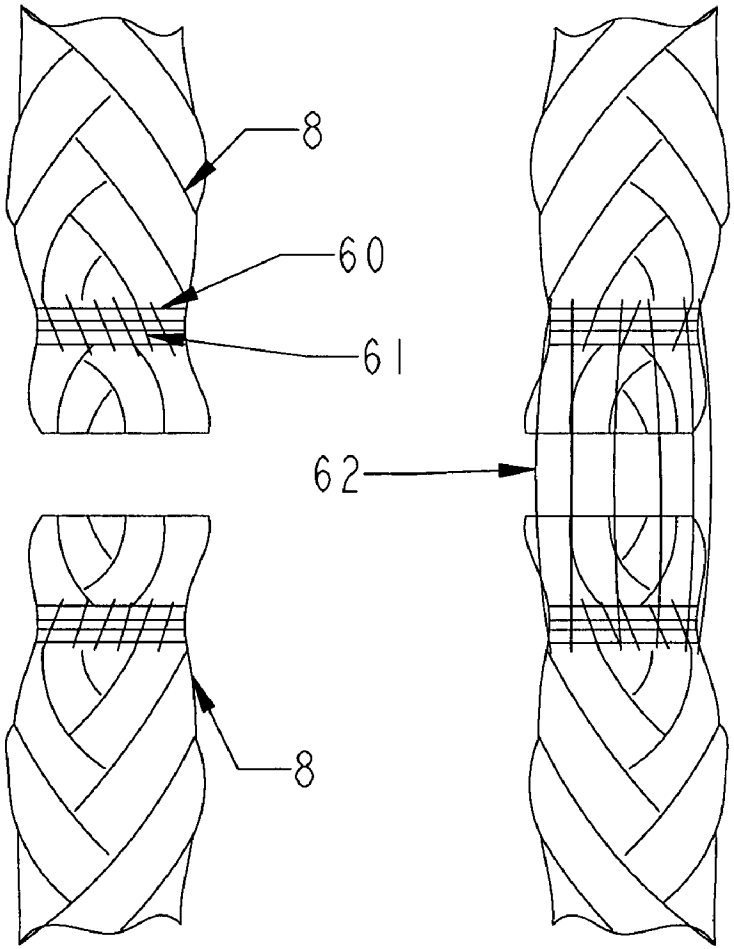
FIG. 20 is an orthographic view of an embodiment of the rope ends.
FIG. 21 is an orthographic view of an embodiment of the rope ends.

FIGS. 20 and 21 illustrate an embodiment where the ends of the rope 8 are wherein the loose individual strands of rope are seized together. Various ways to seize the loose rope fibers include surrounding the end of the rope 8 with a wrap 60, preferably with a high strength twine, then stitching over and under the wrap with high strength twine 61 through the entire thickness of the rope. Permanently seizing the loose strands of the rope 8 can also be accomplished by wrapping the end of the rope 8 with twine 60, 61 and then dipping the end of the rope in epoxy, or wrapping the end of the rope with twine 60, 61 and then melting the loose fibers at the ends of the rope (assuming it is a synthetic rope).

Once the seizing of the two ends is complete, it is recommended that they be locked together by stitching with strong twine, 62 thus achieving a continuous rope. Preferably, the final stitching that locks the two rope ends together causes each stitch to tug on the wrap 60 when the user pulls on the rope.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

What is claimed is:

1. A rope climb simulator apparatus for allowing a user to simulate ascending and descending a rope, the apparatus comprising:

a. a frame;

b. a continuous length of rope:

i. graspable by the user's hands;

ii. generally in the shape of a loop;

iii. configured such that portions of the rope are in contact with the frame;

iv. configured such that a user could apply pulling forces on the rope via a user initiated pulling motion so as to simulate ascending a rope;

c. a braking mechanism to apply resistance to the pulling forces applied to the rope;

d. a governor mechanism that causes the braking mechanism to apply a variable resistance force to the rope in response to the user pulling the rope, said resistance varying depending on the force applied on the rope by the user;

e. a continuously variable height platform attached to the frame that:

i. remains positioned beneath the user during use, and ii. wherein the height of the platform adjusts while the user is pulling on the rope with both hands.

2. The rope climb simulator apparatus as in claim 1, wherein the resistance applied by the braking mechanism is amplified through the use of a plurality of gears.

3. The rope climb simulator apparatus as in claim 1, wherein the resistance applied by the braking mechanism is amplified through the use of a plurality of sprockets.

4. The rope climb simulator apparatus as in claim 1, wherein the resistance applied by the braking mechanism is amplified through the use of a plurality of pulleys.

5. The rope climb simulator apparatus as in claim 1, wherein:

a. the governor is located on a first disk, said first disk and governor allowed to spin at the same speed during use; and b. a second disk fixed in position, wherein the second disk and first disk are pressed together by the governor creating friction; and c. a buffer pad, located between the first and second disks, rigidly mounted to the first disk.

6. The rope climb simulator apparatus as in claim 1, further comprising a shift handle, attached to the frame, capable of exerting a force on a tension rod, wherein the tension rod is located within the governor.

7. The rope climb simulator apparatus as in claim 6, further comprising a spring connected to the tension rod, wherein the spring is capable of exerting a force on the tension rod.

8. The rope climb simulator apparatus as in claim 1, further comprising a rope tensioning bracket.

9. The rope climb simulator apparatus as in claim 8, further comprising a roller functionally connected to the bracket, wherein the tension in the rope is capable of adjustment through manipulating the location of the bracket.

10. The rope climb simulator apparatus as in claim 1, wherein the apparatus is motorless.

11. The rope climb simulator apparatus as in claim 1, further comprising a plurality of rope rollers capable of guiding the rope, where at least one of the rollers further comprises a rope-gripping roller.

12. The rope climb simulator apparatus as in claim 11, wherein the rope-gripping roller is attached to a plurality of sprockets.

13. The rope climb simulator apparatus as in claim 11, wherein the rope-gripping roller is attached to a plurality of gears.

14. The rope climb simulator apparatus as in claim 11, wherein the rope-gripping roller is attached to a plurality of pulleys.

15. The rope climb simulator apparatus as in claim 11, wherein the rope-gripping roller is attached to a sprocket, that is then linked to the governor by a plurality of gears and belts.

16. The rope climb simulator apparatus as in claim 1, wherein the continuous length of rope comprises two ends capable of linking together to form an endless loop, and further comprising two hemispherical pieces capable of attaching together at the junction of the two ends of the rope.

17. The rope climb simulator apparatus as in claim 1, further comprising an electronic display attached to the frame that displays information to the user.

18. The rope climb simulator apparatus as in claim 14 wherein at least one rope roller has a rubber surface.

* * * * *